United States Patent [19]

Waiser

[11] Patent Number: 4,593,675

[45] Date of Patent: Jun. 10, 1986

[54] CROSS BOWS

[76] Inventor: Shimon Waiser, P.O. Box 360, Midwood Station, Brooklyn, N.Y. 11230

[21] Appl. No.: 536,545

[22] Filed: Sep. 28, 1983

[51] Int. Cl.[4] ..... F41B 5/00

[52] U.S. Cl. ..... 124/25

[58] Field of Search ..... 124/25, 27, 83, 35 R, 124/35 A, 41 R, 41 A, 20 R, 16, 23 R, 24 R, 21, 20 B, 22, 20 A

[56] References Cited

U.S. PATENT DOCUMENTS

| | | | |
|---|---|---|---|
| 47,815 | 5/1865 | Hall | 124/21 |
| 230,896 | 8/1880 | Russel et al. | 124/25 |
| 269,249 | 12/1882 | Wilcox | 124/25 |
| 2,661,731 | 12/1953 | Casey | 124/20 A |
| 2,663,291 | 12/1953 | Hall | 124/41 R X |
| 2,715,895 | 8/1955 | Loveless | 124/20 B |
| 2,818,849 | 1/1958 | Woods | 124/22 |
| 2,896,604 | 7/1959 | Rebikoff | 124/22 |
| 3,277,878 | 10/1966 | Pankratz | 124/41 R X |
| 3,643,643 | 2/1972 | Jordan | 124/25 X |
| 3,745,986 | 7/1973 | Crowson | 124/35 R X |
| 3,857,379 | 12/1974 | Burghardt | 124/41 R X |

*Primary Examiner*—Richard J. Apley
*Assistant Examiner*—Robert Bahr

[57] ABSTRACT

A cross bow comprises a bow attached to a bow slide which performs reciprocating motion relatively to a cross bow stock when the cross bow is being cocked. The slide can be maintained in a selected position along the stock by a locking device. To fire projectiles a projectile holder is attached to a bow string. The stock has a longitudinal guideway for guiding the bow slide. The locking device includes a ratchet gear wheel and a spring loaded pawl. A cocking device is provided and includes a gear wheel and a gear rack.

11 Claims, 11 Drawing Figures

135
135a
111d
138
137
114
136
114b
134
111

135b
135
135a 112
132
110
138
135
124
111d
137
136
111

112
131
138
132
135b
133
135
124
137
111
111c
136
114a
114b
114
134

CROSS BOWS

This invention relates to cross bows as used by sportsmen and hunters for shooting arrows (bolts) or projectiles and more specifically to movable bow fastening devices and cocking devices for such cross bows.

The known cross bow has a rigidly mounted bow on the end of the stock which incorporates a trigger mechanism for releasing a taut bow string so as to shoot an arrow therefrom.

The first considerable disadvantage of the known cross bow lies in the fact that the known cross bow always has only one bow draw weight because the distance between the bow and the catch of the bow string is the same for each particular cross bow.

Because in the known cross bow the bow is rigidly fixed to the stock, the bow string has to be pulled to the bow string catch during the cocking of the cross bow using for this purpose user's hands or special cocking devices or means and it is not easy to center the bow string on the bolt when the bow string has full tension of 100÷200 Lb. This is the second disadvantage of the known cross bow.

The third disadvantage of the known cross bow lies in the fact that it is not easy to return the bow string to its initial (uncocked) position without shooting, if desired, after the cross bow was cocked.

Accordingly, it is an object of the present invention to provide a cross bow which avoids the disadvantages of the prior art and has variable bow draw weight from the maximum to zero.

Another object of the invention is to provide a cross bow with a movable slide on which a bow is fastened.

It is a further object of the present invention to provide means in a cross bow for moving the cross bow slide along the stock on purpose to cock the cross bow (cocking means).

It is another object of the invention to provide the cross bow slide with means locking the slide in different desired positions relatively to the catch on purpose to create different bow draw weights.

It is an object of this invention to provide a cross bow with a special projectile holder attached to the bow string and having a special recess to contain a projectile.

It is a further object of the present invention to provide a cross bow with a special catch for holding the projectile holder in cocked position and for concealing the projectile recess of said holder to prevent spontaneous falling out of a projectile before a shot.

Other objects and advantages of the present invention will be apparent from the accompanying description when considered in conjunction with the following drawings full stop, in conjunction with the drawings.

BRIEF DESCRIPTION OF THE INVENTION

Figure 2:
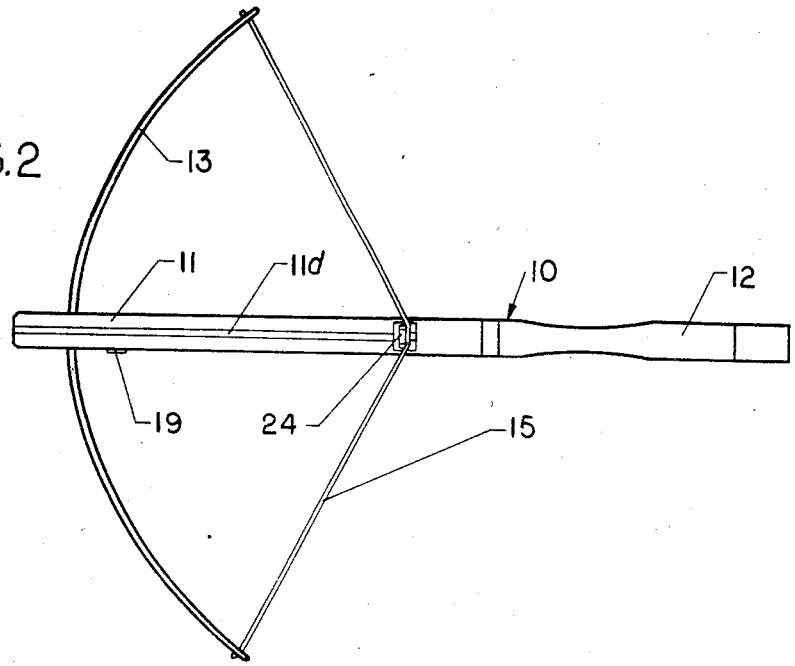
FIG. 2 is a top plan view of the cross bow in a cocked position (with the bow slide maximum moved from the catch)
Figure 1:
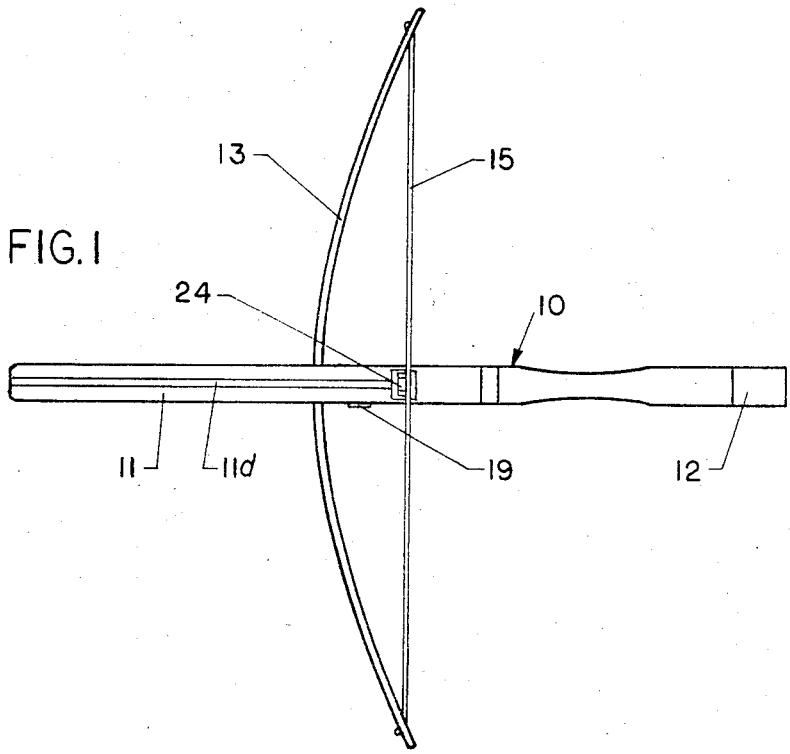
FIG. 1 is a top plan view of the cross bow in an initial precocked position (with the bow slide moved to the catch)
Figure 3:
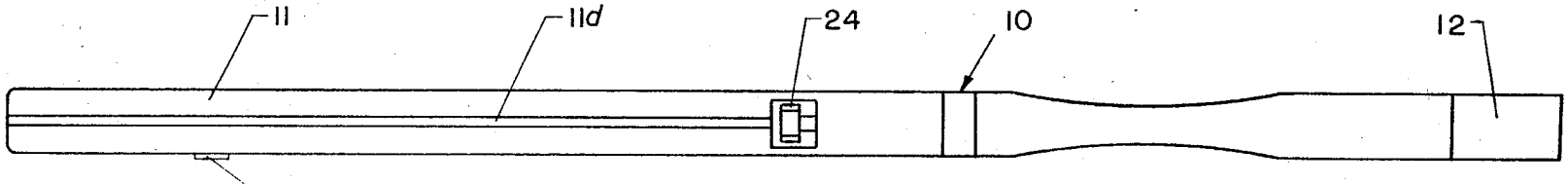
FIG. 3 is an enlarged top plan view of the cross bow similar to FIG. 2 with a bow and a string removed.

Referring more in detail to the drawings, and first to the cross bow disclosed in FIGS. 1, 2, 3, 4, 5, 6 and 7.

The cross bow may be seen to comprise a stock 10 having a fore end portion 11, a butt 12, a bow slide 14 with a bow 13 attached to it and a bow string 15 attached to corresponding ends of the bow 13.

The fore end portion 11 consists of two parts, namely, the upper part 11*a* and the lower part 11*b* and has a bow slide recess 11*c* in which the bow slide 14 is located. The upper and the lower inside surfaces of the recess 11*c* form the guideways along which the bow slide 14 can perform reciprocating motion relatively to the stock when the cross bow is being cocked. Besides, the lower inside surface of the recess 11*c* is toothed and the external upper surface of the fore end portion II has a guideway 11*d* along which a bolt can be projected by the string when the latter is released from the catch.

The bow slide 14 has an aperture 14*a* of rectangular shape corresponding to the cross section of the bow 13. Besides, on the bow slide 14 is mounted an intermediate detail 16 having a square recess 16*a* for connecting with a wrench by which the cross bow can be cocked. On this detail 16 is mounted by a dowel 18 a toothed wheel 17, the teeth of which engage the teeth of the rack 11*b*. Another toothed ratchet wheel 20 is mounted on a square projection of the detail 16 and is fastened to said projection by a screw 19. The teeth of the ratchet wheel 20 engage a pawl 21 which is pivotally mounted on the bow slide 14 by a screw 22 and is under the action of a tension spring 23.

A catch 24 is pivotally mounted in the fore end portion 11 and it is under the action of a tension spring 25. This catch 24 is mainly disposed within a slot which extends from the upper surface to the lower surface of the fore end portion 11. The catch 24 is held in the cocked position by a pivotally mounted trigger 26 which is under the action of a spring 27 and is also mainly disposed within the same slot in the fore end portion 11. A lower portion of the trigger 26 projects from the lower end of the slot so that it is accessible to a user.

In the same slot under the left part of the trigger 26 a safety cam 28 and a safety cam fixing spring 29 are mounted and this safety cam 28 is connected with a safety knob 30 which is located on lateral external surface of the fore end portion to be accessible to the user.

The ratchet wheel 20, the pawl 21, the screw 22, the spring 23, the toothed wheel 17 and the rack 11*b* are components of locking means which allow the slide to move in one direction (to left) and do not allow the slide to move in opposite direction (to right) without disengaging the pawl 21 with the ratchet wheel 20.

The rack 11b, the toothed wheel 17 and an additional wrench (not shown), the square projection of which enters into the square recess 16a of the detail 16, are components of cocking means.

The invented cross bow has actually three positions, namely, (a) postshooting position; (b) precocked position and (c) cocked position.

The postshooting position is the position in which the slide of the cross bow stays after a shot.

The cocked position (see FIG. 2) is the position in which the slide of the cross bow is moved to the fore end of the cross bow from the extreme right position when the bow string is engaged by the catch with the purpose to strengthen the bow string tension and to bend the bow. For this cross bow this position is very indefinite because the slide of the cross bow can be located in any position from the extreme left position to almost the extreme right position depending on desired bow draw weight. The further the slide is moved to the left the greater bow draw weight is.

The precocked position (see FIG. 1) is the position in which the slide is located in the very extreme right position closest to the catch and the bow string is engaged by the catch.

To cock the cross bow when it is in the postshooting position the user should first of all disactivate the locking means by turning counter clockwise the pawl 21 disengaging it with the ratchet wheel 20 and holding said pawl 21 in said position. After this the user should move by hand the slide 14 with the bow 13 and the string 15 on it maximum rearwards. When the bow string 15 reaches the catch 24, the string 15 pushes the upper part of the catch 24 rearwards and clockwise till said upper part of the catch lowers under the level of the bow string 15 allowing the latter to pass above and then the catch 24 under the action of the spring 25 turns counter clockwise to its initial position engaging the bow string 15. After this the user should release the pawl 21 activating the locking means again. Now the cross bow is in the precocked position and to cock the cross bow when it is in said precocked position it is necessary to push the bow 13 by hand or even by foot to the desired cocked position in accordance with desired bow draw weight which can vary from a few lbs. to the maximum possible bow draw weight. For instance the user can make bow draw weight 75 lbs. for indoor shooting and 175 lbs. for hunting.

If it is difficult for the user to push the bow to desired cocked position by hand or by foot he can use for this a mechanic's wrench having a square projection for connection of conventional sockets. The user needs to push the square projection of the wrench into the square recess 16a of the detail 16 and to turn this detail 16 clockwise by said wrench (see FIG. 6). Then the toothed wheel 17 will move forward because of engagement between it and the rack 11b moving the slide 14 with the bow 13 to the desired cocked position.

When the cross bow is cocked and a bolt is placed on its guideway the cross bow is ready to fire.

Figure 4:
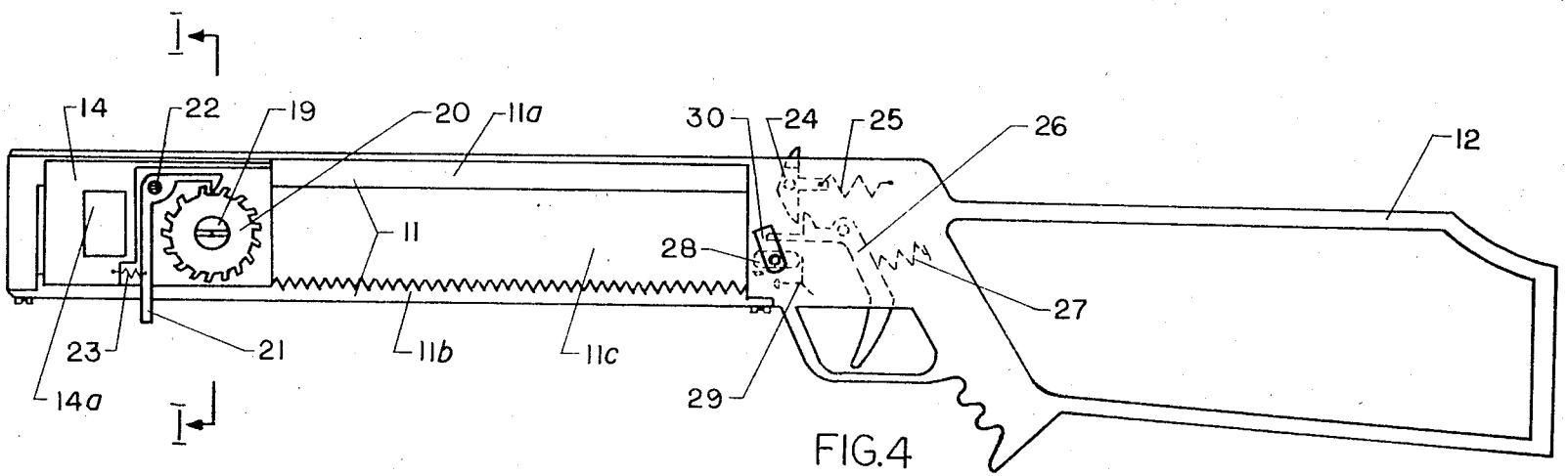
FIG. 4 is a side elevational view of the cross bow of FIG. 3.
Figure 7:
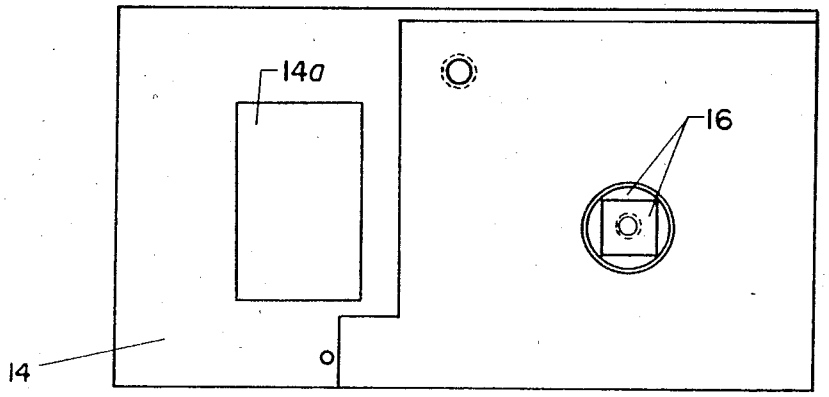
FIG. 7 is a side view of the left hand side of the slide with a toothed ratchet wheel, a pawl and a pawl spring removed.
Figure 6:
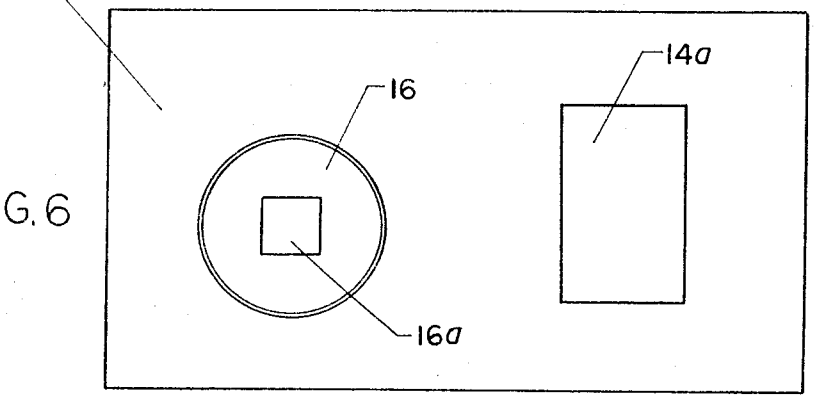
FIG. 6 is a side view of the right hand side of the bow slide with a pawl removed.
Figure 5:
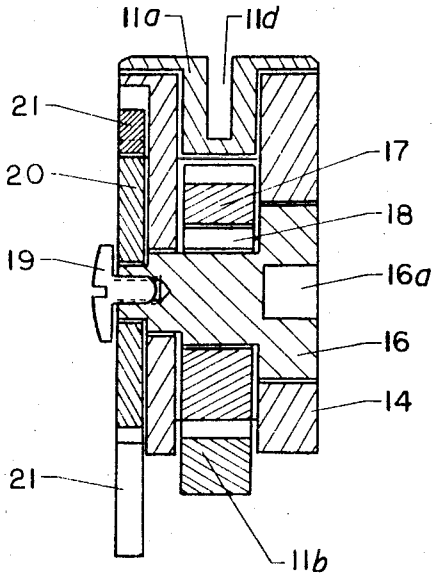
FIG. 5 is an enlarged cross-sectional view of the cross bow of FIG. 4 taken along line I—I.
Figures 8, 9, 10, 11:
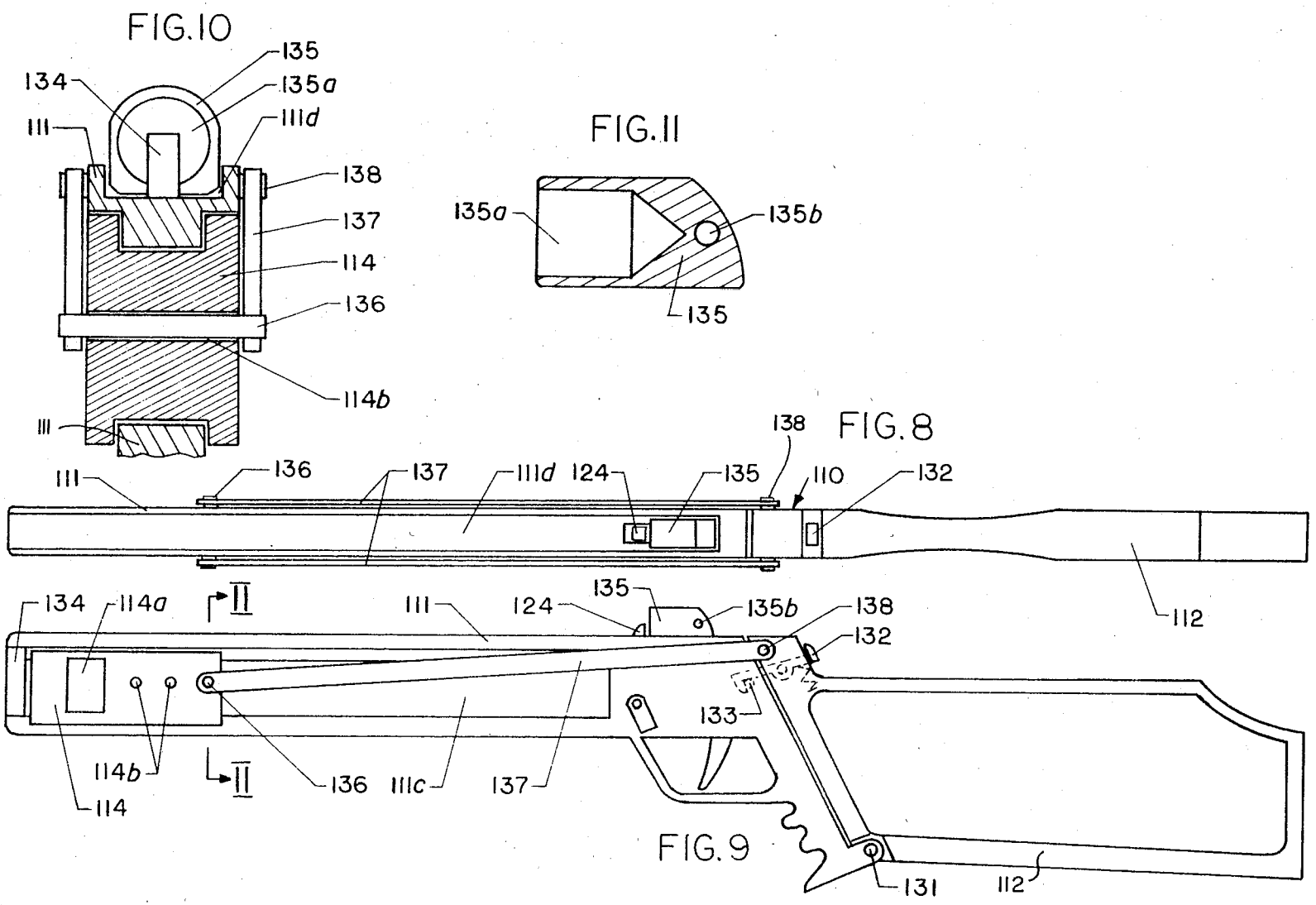
FIG. 8 is a top plan view of the cross bow of the further modification in a cocked position with a bow and a string removed (with the bow slide maximum moved from the catch)
FIG. 9 is a side elevational view of the cross bow of FIG. 8.
FIG. 10 is an enlarged fragmentary cross-sectional view of the cross bow of FIG. 9 taken along line II—II.
FIG. 11 is an enlarged sectional view of the projectile holder.

To fire the cross bow the user should position the safety cam 28 in horizontal position in order not to prevent the trigger 26 to be turned counter clockwise (see FIG. 4). He can make this by turning the safety knob 30 to "OFF" position. After this if the user rotates the trigger 26 counter clockwise he disengages by it the upper part of the trigger 26 with the lower part of the catch 24. The catch 24 under the action of the bow string 15 will turn counter clockwise releasing the string 15, which together with the bolt is propelled forwardly. The spring 25 immediately returns the catch 24 to its initial position and when the user releases the trigger 26 the spring 27 also returns the trigger 26 to its initial position. Now the cross bow is in the postshooting position again and to fire the next bolt the cycle has to be repeated.

Referring now to FIGS. 8, 9 10 and 11 wherein are best shown the general features of the cross bow of the second variation.

The cross bow may be seen to comprise a stock 110 having a fore end portion 111, a but 112, a bow slide 114 with a bow (not shown) attached to it and a bow string (not shown) attached to corresponding ends of the bow.

The butt 112 is connected with the fore end portion 111 for pivoting movement relative thereto about a transverse pivot axis by a pivot pin 131.

To the butt 112 is pivotally attached a spring loaded locking lever 132 which is a part of locking means, the second part of which is an axle 133 attached to the rear part of the fore end portion 111. Said locking means serve to lock the butt 112 in its working position when the butt 112 maximum turned counter clockwise and its fore end surface is parallel to the rear end surface of the fore end portion 111 and said two parallel surfaces contact.

The fore end portion 111 has a slide recess 111c. in which the bow slide 114 is located. The fore end of the fore end portion 111 is shut by a detail 134 which fastens together the upper and the lower parts of the fore end portion 111.

The external upper surface of the fore end portion 111 has a guideway 111d along which a projectile holder 135 can be reciprocating moved. This projectile holder 135 has a recess 135a to contain a projectile (preferably balls of different sizes) and the rear part of said recess 135a has a shape like cone, sphere or other serving to center a ball shaped projectile during a shot. In the rear part of the projectile holder 135 there is a through hole 135b through which the bow string passes.

In the rear part of the fore end portion 111 a slot, which extends from the upper surface to the lower surface of the fore end portion 111, is located. In said slot there are a catch 124, trigger means and safety means which perform the same functions as in the cross bow of FIGS. 1–7 described above. Besides the catch 124 performs one more function which will be described below.

The upper and the lower inside surfaces of the recess 111c of the fore end portion 111 form the guideway along which the bow slide 114 can perform reciprocating motion relative to the stock when the cross bow is being cocked.

The bow slide 114 has an aperture 114a of rectangular shape corresponding to the cross section of the bow which is fastened in said aperture. Besides, the bow slide 114 has three through holes 114b in each of which can be located a pivot pin 136 connecting fore end parts of two cocking members 137 to the bow slide 114. The rear parts of these cocking members 137 are connected to the butt 112 by a pivot pin 138. Both of these cocking members 137 have the same elongate form and are arranged parallel to one another on opposite sides of the fore end portion 111.

The cross bow of the second variation also has three positions, namely: (a) postshooting position; (b) precocked position and (c) cocked position.

The postshooting position is the position in which the slide of the cross bow stays after a shot.

The precocked position is the position in which the bow slide is located in the very extreme right position closest to the catch and the projectile holder is engaged by the catch.

The cocked position is the position in which the bow slide is moved to the fore end of the fore end portion of the cross bow from the precocked position and the cross bow butt 112 is locked in its working horizontal position by locking lever 132. For this cross bow there are three cocked positions depending onto which of three holes 114*b* the cocking members 137 are attached. The further the bow slide is moved to the left the bigger bow draw weight is. So for the cross bow of FIG. 9 the bow draw weight is maximum. If the cocking members 137 are attached to the very left hole 114*b* then the bow draw weight is minimum.

To cock the cross bow when it is in the postshooting position the user should first of all press the projecting right part of the locking lever 132 downwards turning the locking lever 132 clockwise and disengaging it with the axle 133. Then, by pivoting the butt 112 about the pivot pin 131, the cocking members 137 together with the bow slide 114 and attached to the latter the bow with the string and the projectile holder 135 can be moved rearwardly. When the projectile holder 135 reaches the catch 124, the projectile holder 135 pushes the upper part of the catch 124 rearwards and clockwise till said upper part of the catch 124 lowers under the projectile holder 135 allowing the latter to pass above and then the catch 124 under the action of its spring turns counter clockwise to its initial position shutting the projectile recess 135*a* of the projectile holder 135 to prevent spontaneous falling out of a projectile from the recess 135*a*. It is obvious that a projectile has to be placed in the recess 135*a* before said recess is shut by the catch 124. Besides, the catch 124 does not allow the projectile holder 135 to move forward till the user pulls the trigger.

Now the cross bow is in the precocked position and to cock it the user should turn the butt 112 counter clockwise moving by it the bow slide 114 with the bow on it forward and bending the bow. When the butt 112 reaches its working position and the locking lever 132 engages the axle 133 the cross bow is in the cocked position and is ready to fire. The firing process for this cross bow of the second variation is the same as for the cross bow of the previous variation described above.

Many types of cocking and locking means can be used with the invented cross bows but one of them has to be mentioned particularly. This is a hydraulic cocking and locking means which has very same components as a hydraulic car jack, but said components will have much smaller dimensions because a car weight is at least 5–6 times greater than a bow draw weight.

It is obvious that every type of above described cross bows can be supplied with many types of cocking and locking means, both above described and other types.

Although but a few variations of the present invention have been illustrated and described, it will be apparent to those skilled in the art that various changes and modifications may be made therein without departing from the spirit of the invention or from the scope of the appended claims.

What is claimed is:

1. In a cross bow comprising a stock, a bow and a bow string, the improvement including:

(a) a movable bow slide to which said bow is attached, said bow slide being attached to said stock in such a manner that it performs reciprocating motion relatively to said stock when said cross bow is being cocked;

(b) slide locking means fixing said slide in different determined positions relatively to said stock;

(c) a projectile holder which is attachable to said bow string, said holder having a recess for containing a projectile;

(d) a releasable catch for holding said bow string and said projectile holder in a cocked position;

(e) trigger means operatively associated with said catch for effecting release of said bow string and said projectile holder therefrom;

(f) said stock having at least one longitudinally extended guideway conforming to the shape of said bow slide for guiding of said bow slide during its movement;

(g) said stock further having longitudinally extended guide surface conforming to the shape of said projectile holder for guiding of said projectile holder during its movement.

2. A cross bow according to claim 1, further including cocking means to move said bow slide with said bow attached to it relatively to said stock.

3. A cross bow as claimed in claim 2 in which said cocking means include a gear wheel and a gear rack.

4. A cross bow as claimed in claim 2 in which said cocking means include a hydraulic drive having at least one hydraulic cylinder, one ram, one hydraulic valve and one pumping lever.

5. A cross bow as claimed in claim 2 in which said cocking means include a lever pivoted at said stock and at least one cocking member-link one end of which is pivotally attached to said lever and another end of which is pivotally attached to said bow slide.

6. A cross bow as claimed in claim 2 in which said stock includes an elongated fore end portion and a butt pivotally attached to the latter, said cocking means including said butt and at least one cocking member-link one end of which is pivotally attached to said butt and another end of which is pivotally attached to said bow slide.

7. A cross bow as claimed in claim 1 in which said slide locking means include a ratchet gear wheel and a spring loaded pawl.

8. A cross bow as claimed in claim 1 in which said catch conceals said recess of said projectile holder to prevent spontaneous falling out of a projectile before a shot when said cross bow is cocked.

9. A cross bow as claimed in claim 1 in which said recess of said projectile holder has a surface in its rear part which centres a ball-shaped projectile during a shot.

10. In a cross bow comprising a stock, a bow and a bow string, the improvement including:

(a) movable bow slide means to which said bow is attached, said bow slide means being attached to the stock in such a manner that it permits longitudinal motion relative to said stock for changing of a bow tension;

(b) slide locking means fixing said slide means in different longitudinal positions relative to the stock;

(c) said stock having at least one longitudinally extended guideway conforming to the shape of said bow slide means for guiding of said slide means during its movement;

(d) cocking means to move said bow slide means with said bow attached to it relatively to said stock;

(e) said cocking means include a gear wheel and a gear rack.

11. In a cross bow comprising a stock, a bow and a bow string, the improvement including:

(a) movable bow slide means to which said bow is attached, said bow slide means being attached to the stock in such a manner that it permits longitudinal motion of said slide means relative to said stock for changing of a bow tension;

(b) slide locking means fixing said slide means in different longitudinal positions relative to the stock;

(c) said stock having at least one longitudinally extended guideway conforming to the shape of said bow slide means for guiding of said slide means during its movement;

(d) said slide locking means include a ratchet gear wheel and a spring loaded pawl.

* * * * *